US005794103A

United States Patent [19]

Oh

[11] Patent Number: 5,794,103

[45] Date of Patent: Aug. 11, 1998

[54] DEVELOPER UNIT MOUNTING/ DETACHING DEVICE IN A LASER BEAM PRINTER FOR REPLACEMENT OF DEVELOPER UNIT WITHOUT OPENING AND CLOSING A COVER

[75] Inventor: Gaun-Jong Oh, Kyungki-do, Rep. of Korea

[73] Assignee: SamSung Electronics Co., Ltd., Kyungki-do, Rep. of Korea

[21] Appl. No.: 802,206

[22] Filed: Feb. 18, 1997

[30] Foreign Application Priority Data

Feb. 17, 1996 [KR] Rep. of Korea ..... 1996/3964

[51] Int. Cl.[6] ..... G03G 15/04

[52] U.S. Cl. ..... 399/119; 399/110

[58] Field of Search ..... 399/111, 114, 399/107, 108, 110, 119

[56] References Cited

U.S. PATENT DOCUMENTS

| | | | |
|---|---|---|---|
| 4,931,837 | 6/1990 | Abuyama et al. | 399/119 X |
| 5,066,976 | 11/1991 | Kanagawa et al. | 399/111 |
| 5,266,998 | 11/1993 | Lee | 399/119 X |
| 5,285,240 | 2/1994 | Kinoshita et al. | 399/110 |
| 5,379,092 | 1/1995 | Takashima | 399/119 X |
| 5,528,342 | 6/1996 | Setoriyama | 399/107 |
| 5,550,617 | 8/1996 | Odagawa et al. | 399/111 X |
| 5,565,961 | 10/1996 | Shoji et al. | 399/111 |
| 5,583,612 | 12/1996 | Schell et al. | 399/107 |

*Primary Examiner*—S. Lee

*Attorney, Agent, or Firm*—Robert E. Bushnell, Esq.

[57] ABSTRACT

A developing unit mounting/detaching device for a laser beam printer includes a handle used to lift or draw a developing unit into or out of a space in the printer's main body; a locking mechanism for preventing dislocation of the developing unit from the space; a release button assembly for releasing the locking member; and a contact pressure maintenance device for properly maintaining the contact pressure between a photo conductive drum in the developing unit and the transfer roller of the main body.

20 Claims, 9 Drawing Sheets

DEVELOPER UNIT MOUNTING/ DETACHING DEVICE IN A LASER BEAM PRINTER FOR REPLACEMENT OF DEVELOPER UNIT WITHOUT OPENING AND CLOSING A COVER

BACKGROUND OF THE INVENTION

1. Field of the Invention

The present invention relates to a laser beam printer. More particularly, it relates to a developing unit mounting/detaching device for a laser beam printer which allows replacement of the developing unit without opening or closing any cover of the printer.

2. Discussion of Related Art

A laser beam printer includes a paper feeding unit for feeding paper into a printing unit, a static electric charging unit for uniformly charging the outer surface of the printer's photo conductive drum during paper conveyance, a developing unit for converting a latent image formed on the outer surface of the photo conductive drum to a toner image, a transfer unit for transferring the toner image to the paper, a conveyance unit for guiding the paper onto which the toner image is transferred, and a fixing unit for fusing the toner image onto the paper by heat and pressure thus completing the printing operation.

The developing unit, which is an article of consumption, houses a photo conductive drum, a charging roller that uniformly charges the outer surface of the photo conductive drum rotating, a developing roller for converting a latent image, created by a laser beam corresponding to a digital signal from a computer, on the charged surface of the photo conductive drum, into a toner image, and a toner supply roller, and a toner housing. Therefore, when the toner is exhausted, the developing unit must be replaced with new one. FIGS. 1 to 3 depict a conventional developing unit mounting/detaching mechanism.

Using the conventional developing unit mounting/detaching mechanism, a user must open and close a developing unit cover 2 every time he attempts to replace expended developing unit 9 with a new one. In addition, the conventional developing unit mounting/detaching mechanism can stain the user's hands with toner.

Developing unit cover 2 automatically opens upwards when released by pressing a release button 3. As shown in FIG. 2, developing unit cover 2 has a complicated construction and must be connected to a printer body 1 by various parts such as hinge brackets 4, hinge pins 5, tension springs 6 and screw fasteners 7, which increases production costs and decreases production yield.

The printer has a driving section for printing operation, and as the driving section and power transmission section operate, vibration inevitably occurs. Thus, it is preferable that the printer have a one piece housing. If the printer has a multiple piece housing, vibration and noise may be created by the joint between the housing pieces protecting the printer.

In spite of this problem, the conventional laser beam printer includes developing unit cover 2 that also serves as a part of the printer housing, thus essentially has a two piece housing.

The vibration created between printer housing 8 and developing unit cover 2 by the operation of the printer's driving section causes interference between them, thus making noises that gradually decreases the product quality. This problem may occur gradually as the printer is used over a long period of time.

SUMMARY OF THE INVENTION

Accordingly, the present invention is directed to a developing unit mounting/detaching device that substantially obviates one or more of the problems, limitations and disadvantages of the related art.

It is an objective of the present invention to produce a a developing unit mounting/detaching device for a laser beam printer which facilitates replacement of a developing unit which is an article of consumption.

It is another objective of the present invention to produce a developing unit mounting/detaching device for a laser beam printer which allows the printer housing to be constructed as a single piece for advantageous yield aspects and lower production costs.

Additional features and advantages of the invention will be set forth in the description which follows, and in part will be apparent from the description, or may be learned through practice of the invention. The objectives and other advantages of the invention will be realized through the structure, particularly as pointed out in the written description and claims hereof, as well as the appended drawings.

To achieve these and other advantages, and in accordance with the purpose of the present invention as embodied and broadly described, a developing unit mounting/detaching device for a laser beam printer includes, a handle used to lift or draw a developing unit into or out of a space in the printer's main body; a locking mechanism for preventing dislocation of the developing unit from the space; a release button assembly for releasing the locking member; and a contact pressure maintenance device for properly maintaining the contact pressure between a photo conductive drum in the developing unit and the transfer roller of the main body.

According to another aspect of the present invention, the handle is formed on the developing unit's top surface which is to be exposed to outside, where the developing unit's top surface is flush with the top of the main body housing. The handle is a concave lip formed on the developing unit's top surface.

It is to be understood that both the foregoing general description and the following detailed description are exemplary and explanatory, and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 1 schematically depicts a laser beam printer with a conventional developing unit mounting/detaching mechanism;

Figure 1:
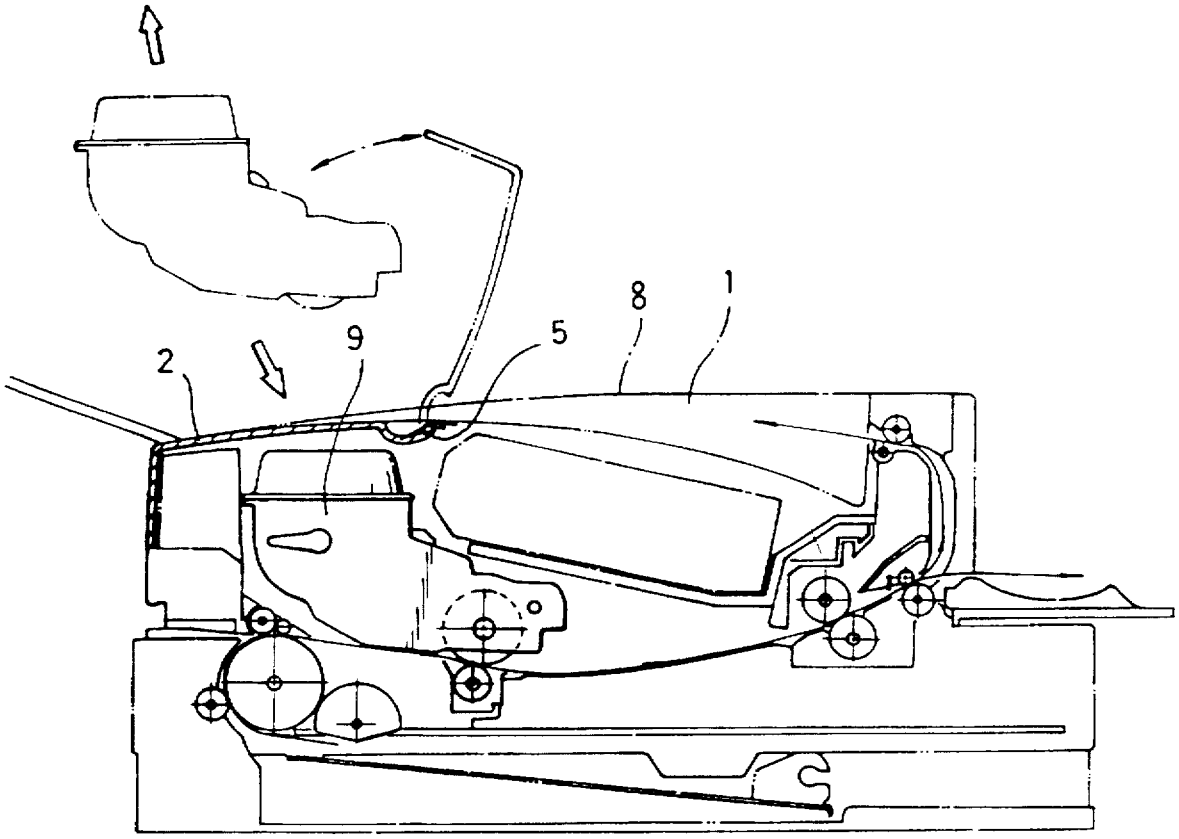
Figure 2:
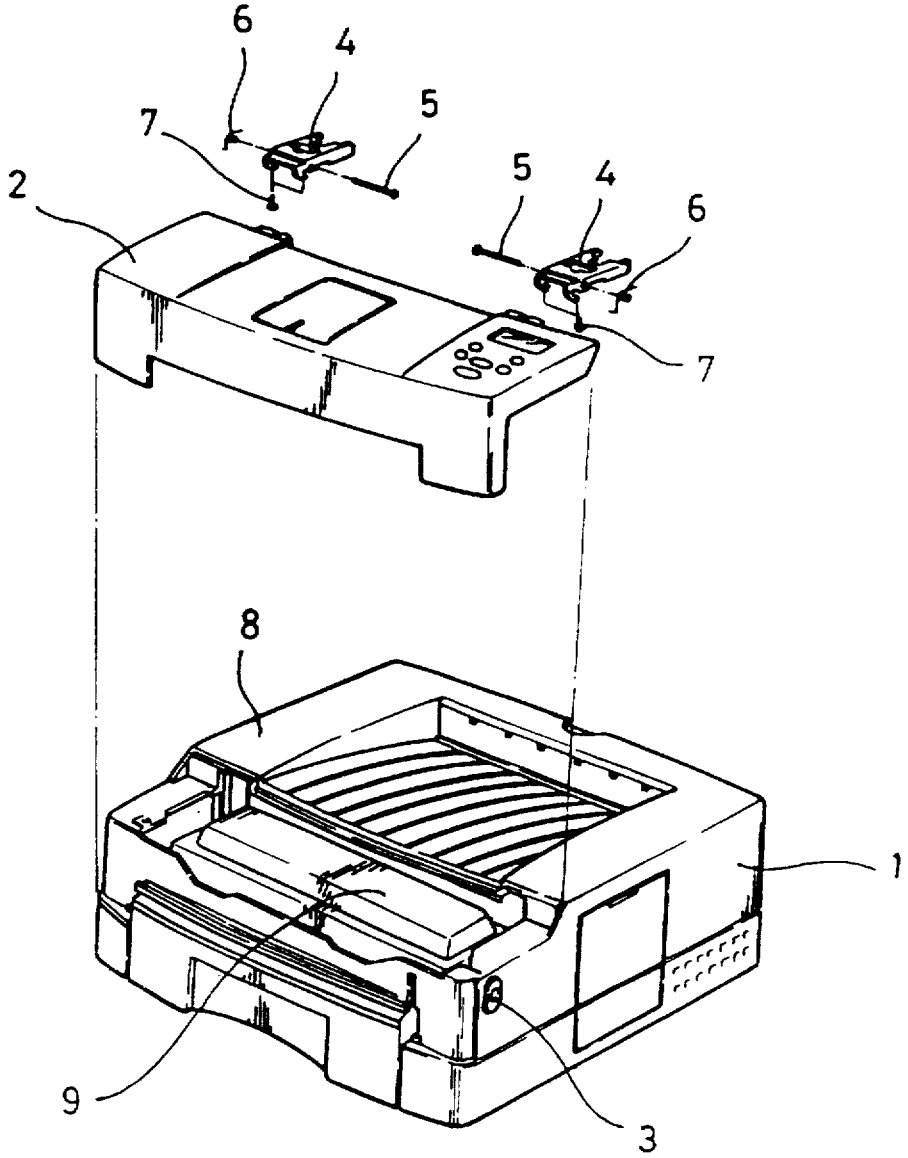
FIG. 2 is an exploded perspective view of a developing unit cover for the conventional developing unit mounting/detaching mechanism.
Figure 3:
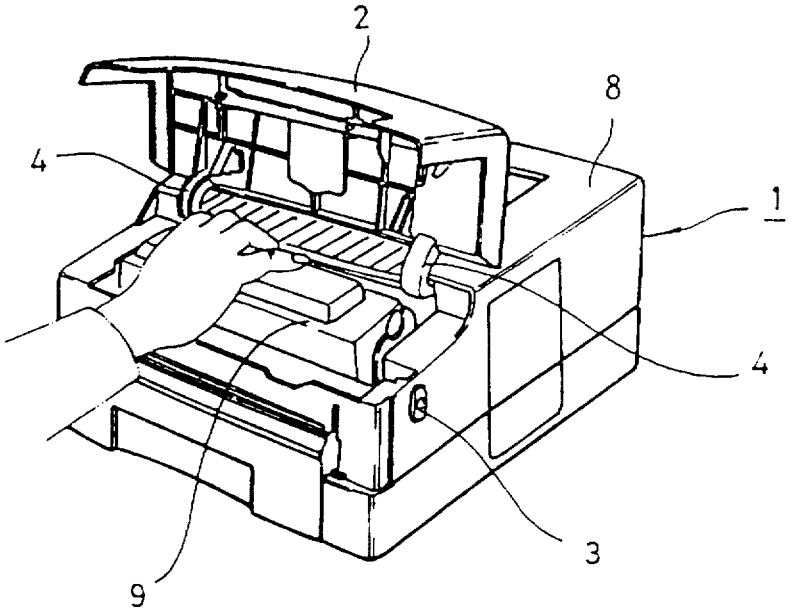
FIG. 3 shows replacement of a developing unit in accordance with the conventional developing unit mounting/detaching mechanism.
Figure 4:
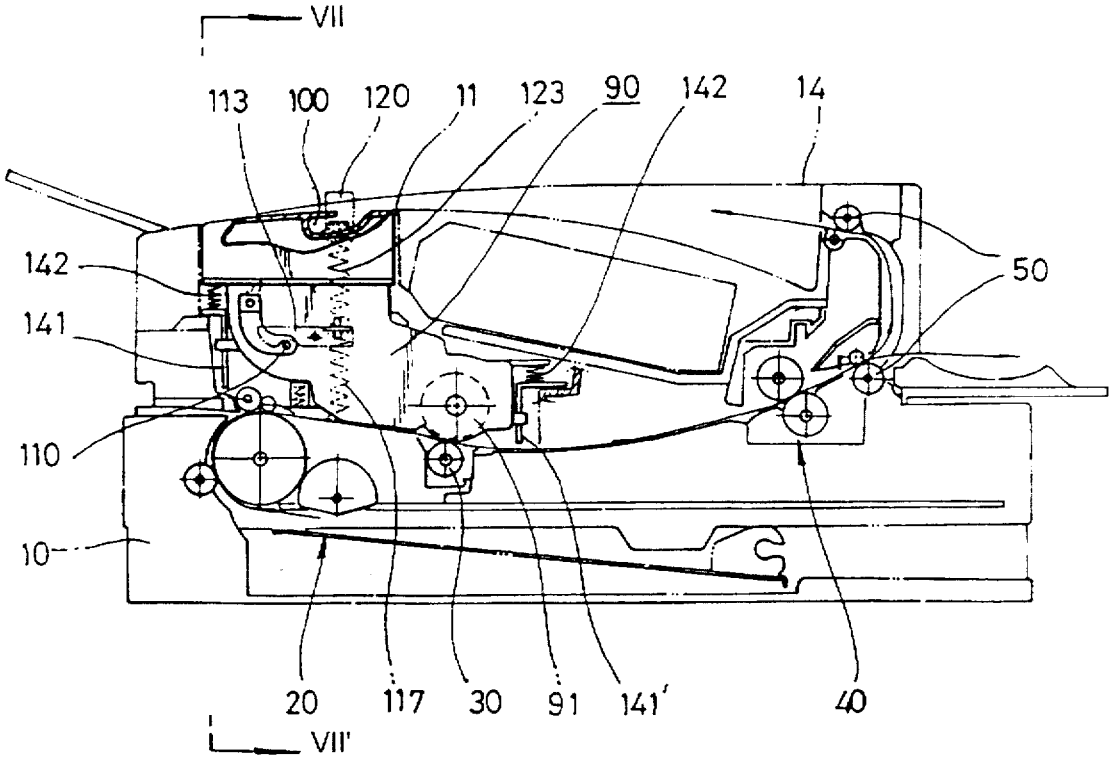
Figure 5:
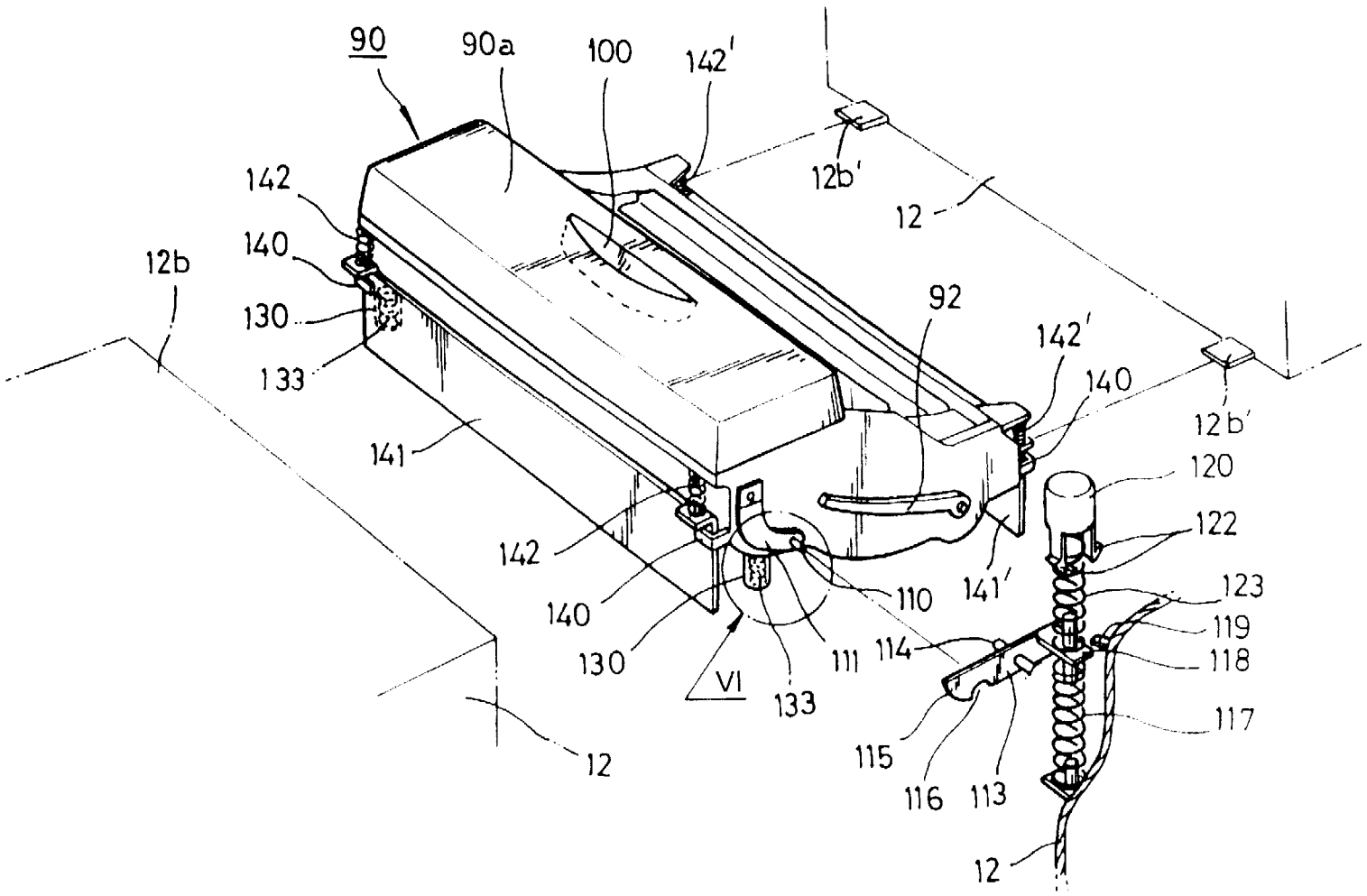
Figure 6:
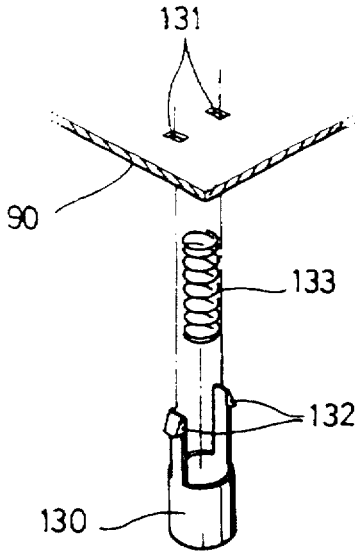

FIG. 4 schematically depicts a laser beam printer to which the present invention is applied;

FIG. 5 is a partially-exploded perspective view of a developing unit mounting/detaching device in accordance with the present invention;

FIG. 6 is an enlarged view of "VI" of FIG. 5; and

Figure 7:
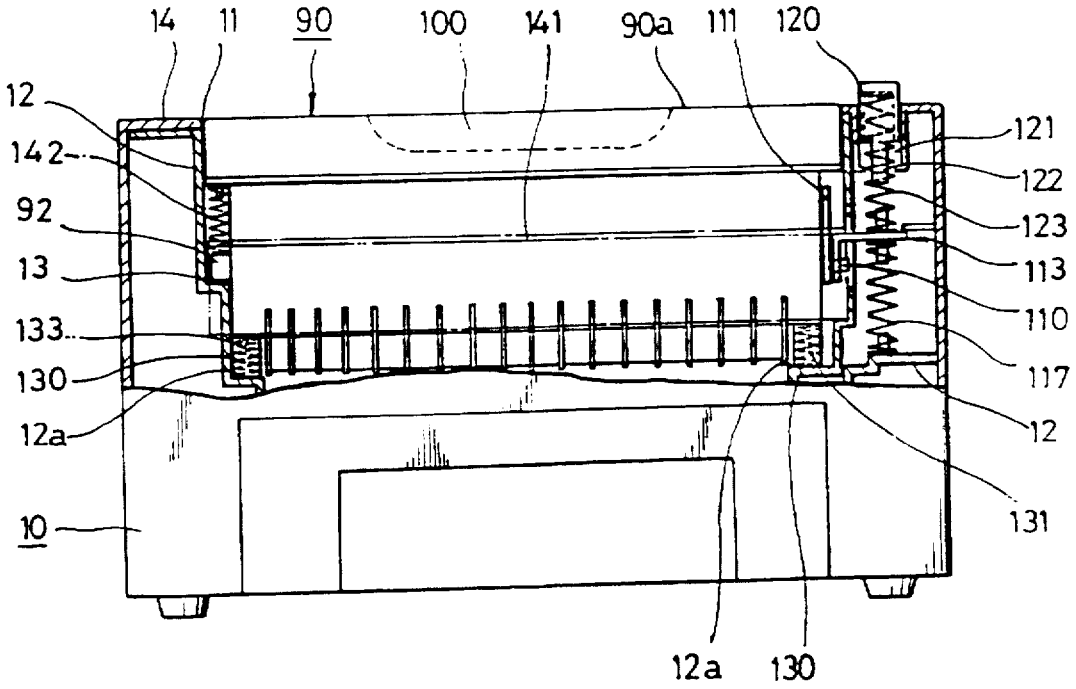
Figure 8:
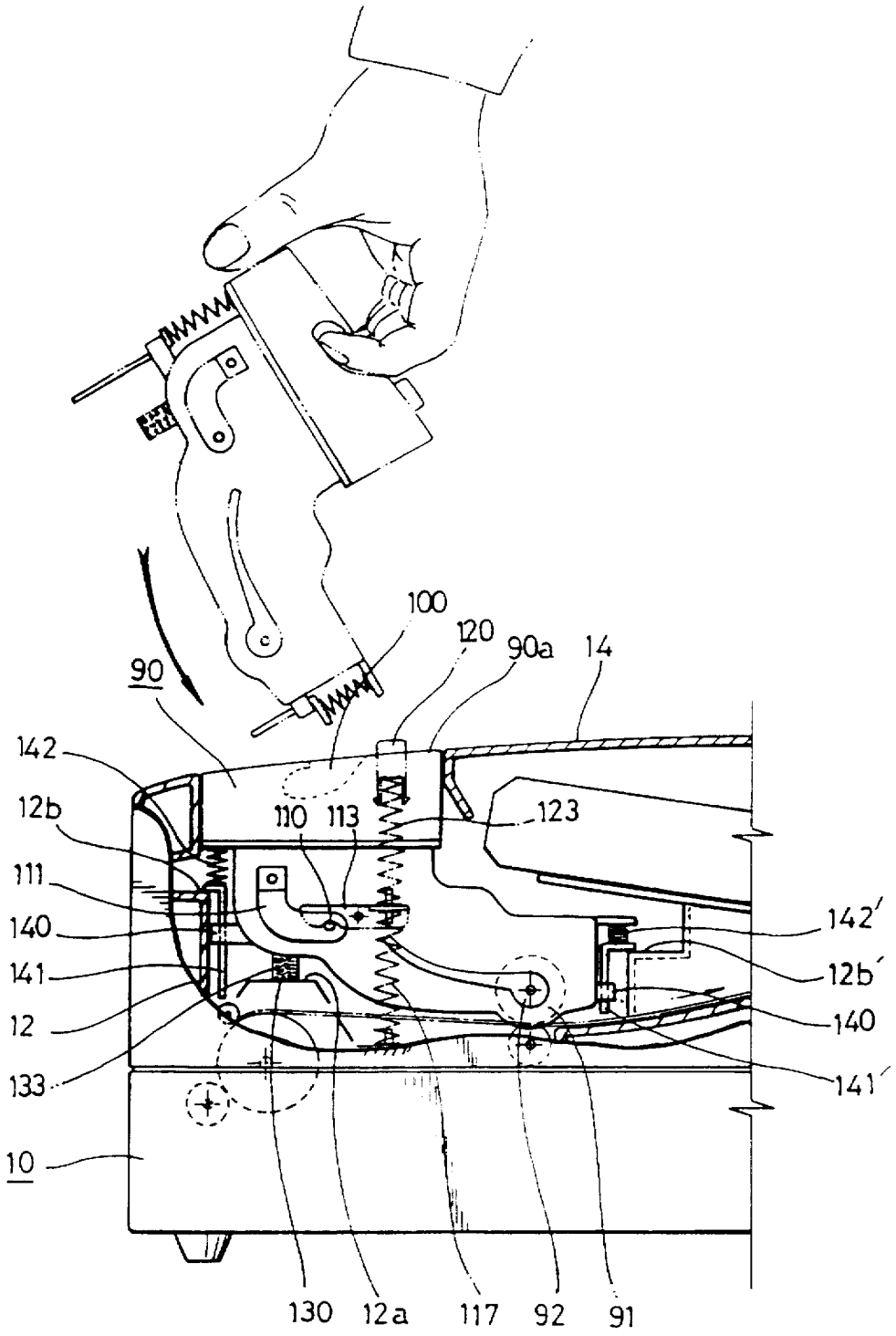
Figure 9:
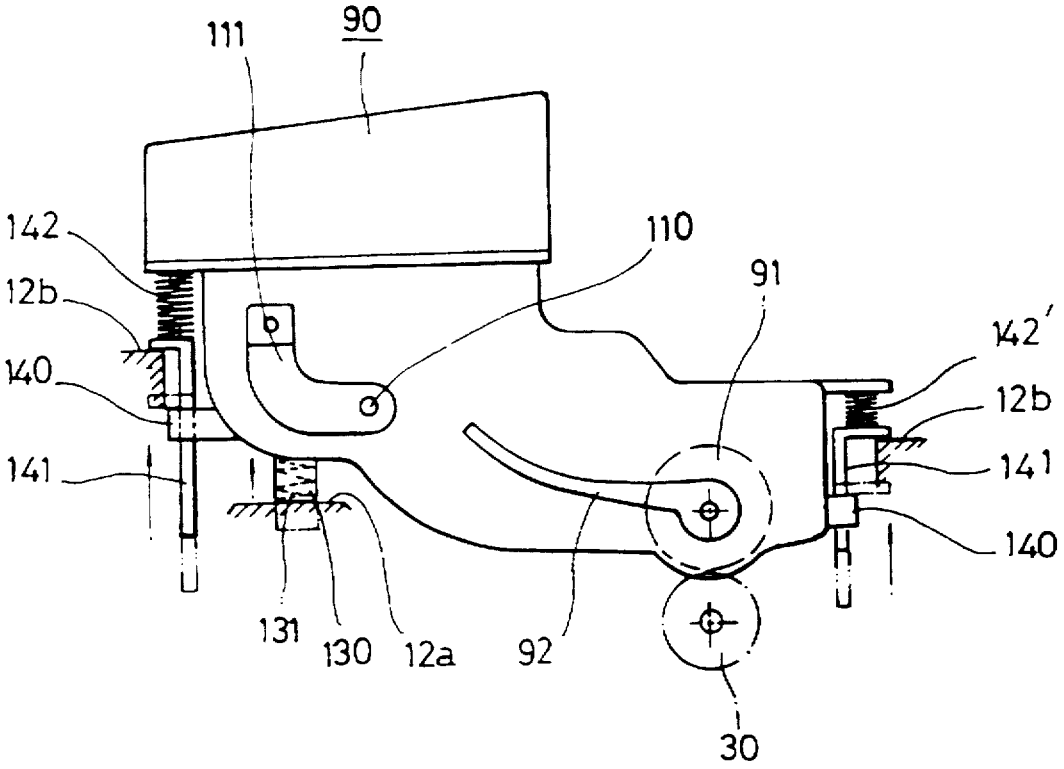
Figure 10A:
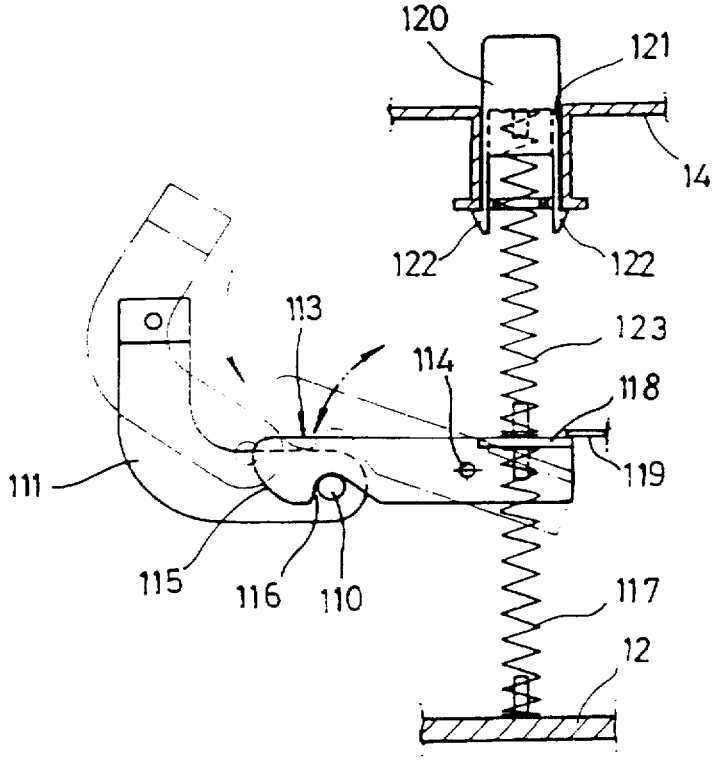
Figure 10B:
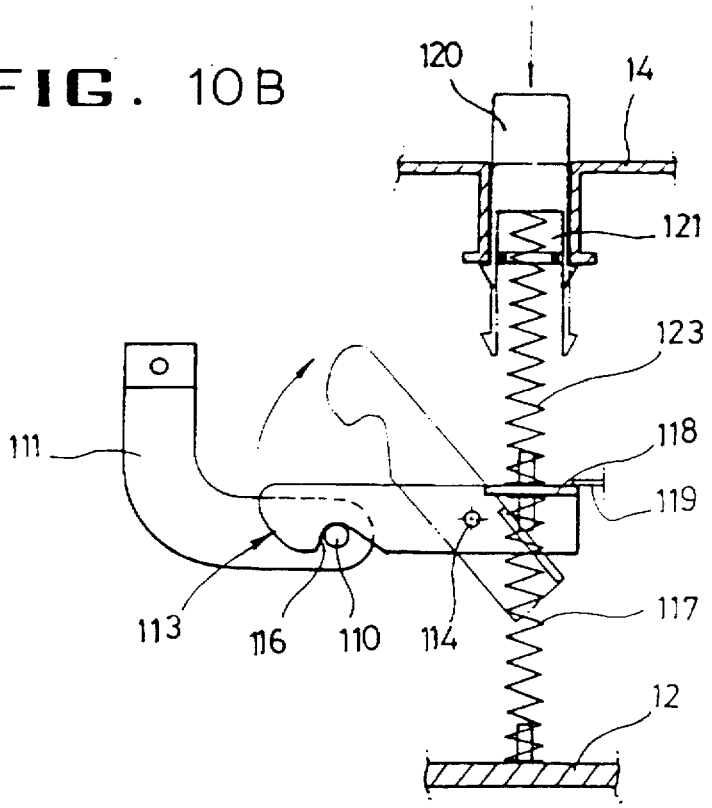
Figure 11:
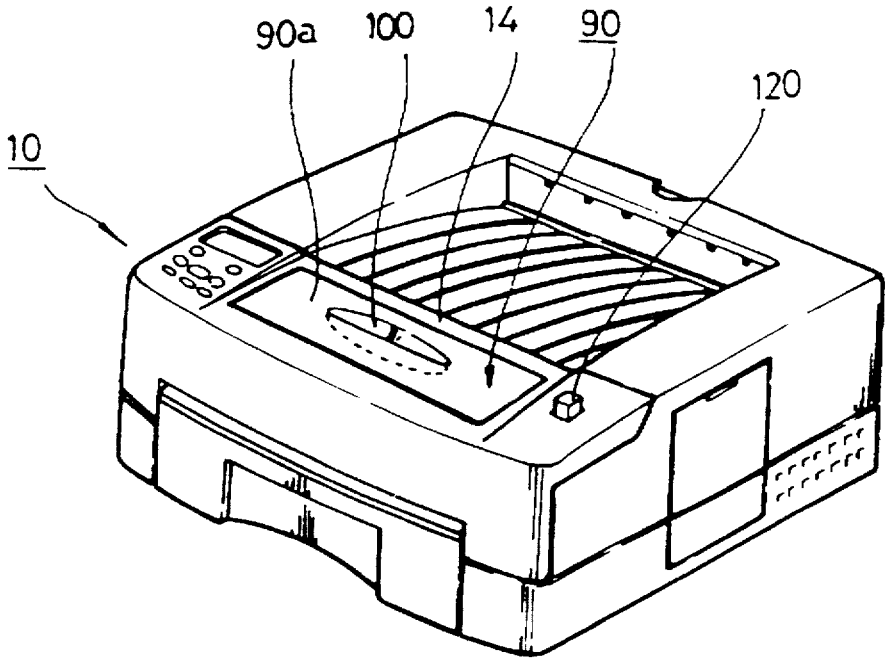

FIG. 7 is a sectional view as taken along line "VII—VII" of FIG. 4;

FIG. 8 is a cutaway side-sectional view showing the inventive developing unit mounting mechanism;

FIG. 9 is a schematic side view showing a contact force maintaining device and a photo conductive drum protecting device in accordance with the present invention;

FIG. 10A is a schematic side view for describing the operation of a locking member in accordance with the present invention;

FIG. 10B is a schematic side view for describing the operation of a release button assembly in accordance with the present invention; and FIG. 11 a perspective view of the overall laser beam printer when mounting the developing unit thereon in accordance with the present invention.

DETAILED DESCRIPTION OF PREFERRED EMBODIMENT

Reference will now be made in detail to the preferred embodiments of the present invention, examples of which are illustrated in the accompanying drawings.

FIG. 4 schematically depicts a laser beam printer to which the present invention is applied.

Paper fed from a paper feeding unit 20, passes between a photo conductive drum 91, in a developing unit 90, and a transfer roller 30, in a printer's main body 10, so that toner is transferred onto the paper. The toner is fused to the paper by a fixing unit 40, and delivery rollers 50 discharge the paper to a top output tray.

Main body 10 has a space 11, which developing unit 90 fits into, and a supporting frame 12, around space 11, to securely support developing unit 90.

Referring to FIGS. 5 and 7, a guide 92 is located on either side of developing unit 90 to engage with a groove 13 in supporting frame 12 so that developing unit 90 is securely supported. Developing unit 90 has a handle formed its top surface 90*a*. The handle is designed to protrude from top surface 90*a* so as to avoid paper jams because paper is output through the portion where developing unit 90 is placed. However, the handle may be designed to slightly protrude from top surface 90*a* if circumstances require, and it is preferable that the handle is not protruded.

The handle is a concave lip 100 formed on top surface 90*a* of developing unit 90. In order to expose concave lip 100 to the outside, developing unit 90's top surface 90*a* is designed to be flush with the top of a housing 14 when developing unit is inserted into space 11.

Developing unit 90's locking mechanism serves to prevent developing unit 90 from being removed from space 11 or moving during printing. The locking mechanism is depicted in FIGS. 5, 10A, and 10B. This locking mechanism, located on one side of developing unit 90, includes a locking projection 110 and a bracket 111. Since the outer case of developing unit 90 is made of plastic, locking projection 110 is formed on bracket 111 and fastened to each side of developing unit 90. When inserting developing unit 90 containing locking projection 110 into space 11, locking projection 110 engages locking lever 113. Locking lever 113 pivots at its middle on a pivot pin 114 that is attached to supporting frame 12. Locking lever 113 has a rounded edge 115 at its front end and a hook 116 into which locking projection 110 mates. Rounded portion 115 and hook 116 of locking lever 113 are formed in front of pivot pin 114, to be opposed when an elastic force acts on locking lever 113's rear portion 118 by an elastic member 117

Preferably, a compression coil spring serves as lever elastic member 117 though a plate spring may also be used. A stop 119 limits the movement of rear portion 118, preventing it from rotating out of position under the force of elastic member 117. When locking lever 113 is caught by stopper 119, it is in a horizontal position. A release button assembly is designed to sufficiently lift the locking member to release the developer unit.

The release button assembly includes a press button 120, where press button 120 is mounted on main body 10 of the printer. Barbs 122 are formed on press button 120 so as to prevent press button 120 from being removed from button hole 121. A release spring 123 is located under press button 120, with which the rear portion of locking lever 113 is acted upon when the button is depressed. A compression coil spring serves as release elastic member 123, and another elastic means or rod that can press rear portion 118 can be used as release elastic member 123.

As shown in the drawing, where release elastic member 123 is used, the elastic force of release elastic member 123, that is increased by pressing press button 120, must be larger than lever elastic member 117's. When pressing press button 120 to release the locking member, the elastic force of release elastic member 123 exceeds lever elastic member 117's, so that locking lever 113 pivots about pivot pin 114 clockwise to release the lock-up condition.

By fitting developing unit 90 into space 11, photo conductive drum 91, of developing unit 90, comes in contact with transfer roller 30, of main body 10, so as to transfer a toner image to paper. The contact pressure must be maintained at a predetermined level to achieve the best print quality. Accordingly, the inventive developing unit 90 is equipped with a device for maintaining an appropriate contact pressure between photo conductive drum 91 and transfer roller 30. The contact pressure maintenance device is located at both sides under developing unit 90. As shown in FIG. 6, there is a supporting body 130 having barbs 132 that fit into snap holes 131, located on the bottom of developing unit 90, and a compression maintenance spring 133, installed within supporting body 130 to allow the elastic force to act downward.

Preferably, a compression coil spring serves as compression spring 133, and supporting body 130 is pressed downward. A photo conductive drum protecting device serves to prevent photo conductive drum 91 from touching other components inside of the printer and being damaged. A photo conductive drum protection device is installed on developing unit 90 itself, where the drum covers 141 and 141' move up and down along a guide 140 located on both sides of developing unit 90, are designed to operate against a compressed elastic force from cover compressing springs 142 and 142'. Preferably, a compression coil spring serves as cover compressing springs 142 and 142', though other elastic means such as plate springs can be used.

Referring to FIG. 8, the steps of mounting the inventive developing unit are now described.

Developing unit 90 is an article of consumption, and is created as to be an independent component. A user fits or draws developing unit 90 into or from space 11, putting his fingers in handle 100, as indicated by dotted line of FIG. 8. If developing unit 90 is relatively long, he must fit or draw developing unit 90 into or from space 11, giving a slight tilt to developing unit 90. When developing unit 90 is completely inserted into space 11, it is horizontal to be mounted on the printer. When the insertion of developing unit 90 is almost complete, the locking member prevents dislocation of developing unit 90. FIG. 10A shows the operation state of the locking member. Locking lever 113 is horizontal when developing unit 90 is not in space 11. As developing unit 90 moves into its final position within space 11, rounded portion 115 of locking lever 113 is caught by locking projection 110, lifting the lever over the rounded portions (refer to FIG. 10's dotted line).

Thus, when developing unit 90 is in position in space 11, locking projection 110 is moved under locking lever 113. As locking projection 110 reaches hook 116, locking lever 113 pivots so that its front end, that was raised a little against the elastic force of lever elastic member 117 acting on its rear portion 118, moves downward, whereby locking projection 110 fits into hook 116.

Locking projection 110 is not released by hook 16 until locking lever 113's front end is raised. In addition, as the elastic force of lever spring 117 continuously acts on rear portion 118, locking lever 113's front end continues pressing locking projection 110, thus developing unit 90 becomes securely mounted inside the printer.

The contact force maintenance device operates simultaneously with the locking member when mounting developing unit 90. Supporting body 130 is caught by supporting frame 12's catch 12*a* when the mounting of developing unit 90 in the printer is complete. Accordingly, supporting body 130 moves up, and compression maintaining elastic member 133, located inside supporting body 130, is compressed by the elevation of supporting body 130. The compression elastic member 133 creates compression of a magnitude predetermined according to developing unit 90's load and peripheral structure, and this compression constantly maintains the contact force between photo conductive drum 91 and transfer roller 30. The photo conductive drum protecting device operates simultaneously with the operation of the locking member and contact force maintaining device. The photo conductive drum protecting device operates in the step of fitting developing unit 90 into space 11, and drum protecting covers 141 and 141' get caught on catching portions 12*b* and 12*b'* respectively formed on supporting frame 12, thus making drum protecting covers 141 and 141' move out of the path of paper conveyance.

Since drum protecting covers 141 and 141' are completely raised when developing unit 90 has fitted into space 11, it prevents photo conductive drum 91 from touching other components during the insertion of developing unit 90 into space 11, thus avoiding damage to the surface of photo conductive drum 91. When developing unit 90 is completely inserted into space 11, developing unit 90's upper portion 90*a* is flush with the top of the housing 14 of main body 10. Therefore, when a user replaces the used developing unit 90 with a new one, all he has to do is to just draw developing unit 90 out of space 11 without opening any cover. When a user wants to remove developing unit 90 from the printer, the first thing he has to do is to release the developing unit 90 by pressing release button assembly.

FIG. 10B depicts the operation of the release button assembly for replacement of developing unit 90. If press button 120 is pushed, release spring 123 presses locking lever 13's rear portion 118. At this point, release elastic member 123's elastic force exceeds lever elastic member 117's, and locking lever 113 pivots clockwise about pivot pin 114.

As locking projection 110 comes out of hook 116 and developing unit 90 is lifted upward, developing unit 90 is drawn out of space 11. It is preferable that a user presses press button 120 until developing unit 90 is completely drawn out of space 11.

Accordingly, if press button 120's pressing force is removed after drawing developing unit 90 out of space 11, each of lever elastic member 117 and release elastic member 123 return to their original states. The step of fitting a new developing unit into space 11 is the same as described above.

The present invention provides a printer whose developing unit may be easily replaced with new one, without extra developing unit cover, thus lowering the production costs. Since the housing of the printer's main body is designed to be one piece according to the present invention, the present invention reduces vibration that may be created as the printer operates, and assures a noise-free printer, increasing the reliability of the printer In addition, the present invention facilitates replacement of a used developing unit with new one, and prevents a user's hands from being stained with toner during replacement, which is desirable feature for users.

It will be apparent to those skilled in the art that various modifications and variations can be made in the developing unit mounting/detaching device for a laser beam printer of the present invention without departing from the spirit or scope of the invention. Thus, it is intended that the present invention cover the modifications and variations of this invention provided they come within the scope of the appended claims and their equivalents.

What is claimed is:

1. A developing unit mounting/detaching device for a laser beam printer, comprising:

handling means permitting insertion of a developing unit into a space formed in a main body;

locking means for preventing dislocation of the developing unit from the space formed in the main body;

release button means for releasing the locking means from locking the developing unit in the main body; and contact pressure maintenance means for properly maintaining contact pressure between a photo conductive drum of the developing unit and a transfer roller installed in the main body.

2. The developing unit mounting/detaching device of claim 1, further comprised of said handling means corresponding to a handle formed on the top of the developing unit for user insertion of the developing unit into the main body and for user removal of the developing unit from the main body, and where the top of the developing unit is flush with the top of the main body, when the developing unit is inserted into the main body.

3. The developing unit mounting/detaching device of claim 1, further comprised of said handling means corresponding to a handle in a form of a concave lip formed on the top of the developing unit enabling user insertion of the developing unit into the main body and user removal of the developing unit from the main body.

4. The developing unit mounting/detaching device of claim 1, wherein said locking means comprises a locking projection protruding from one side of the developing unit, and a locking lever having a hook into which the locking projection fits for fastening as said locking lever pivots about a pivot pin attached to a support frame so that said locking lever turns under the loading of a lever elastic member to lock the developing unit in the main body.

5. The developing unit mounting/detaching device of claim 4, wherein said lever elastic member is a compression coil spring.

6. The developing unit mounting/detaching device of claim 4, further comprised of said locking means comprising a stopper disposed to prevent said locking lever, to which an elastic force of the lever elastic member is applied, from rotating counterclockwise beyond a specific point.

7. The developing unit mounting/detaching device of claim 1, wherein said release button means comprises a manually depressable button located in a button hole to partially protrude from a top surface of the main body, and a release elastic member applying pressure to release said locking means from locking the developing unit from the main body in response to depression of the button.

8. The developing unit mounting/detaching device of claim 1, wherein said contact pressure maintenance means comprises a supporting body having barbs which fit into snap holes formed on a bottom of the developing unit, and a compression maintenance elastic member applying an elastic force to the supporting body.

9. The developing unit mounting/detaching device of claim 8, wherein said compression maintenance elastic member is a compressable coil spring.

10. The developing unit mounting/detaching device of claim 1, further comprising photo conductive drum protection means installed in front of and at the rear of the developing unit for protection of the photo conductive drum when the developing unit is inserted into the main body.

11. The developing unit mounting/detaching device of claim 1, further comprising photo conductive drum protection means for protection of the photo conductive drum when the developing unit is inserted into the main body said photo conductive drum comprising guides each securely attached to front and rear s portions of the developing unit, drum protection covers raised by catches on a supporting frame of the main body, and cover compression elastic members for loading the drum protection covers so that they remain closed when not engaged by the catches on the supporting frame of the main body.

12. An image forming apparatus, comprising:

a main body of a unitary structure having an opening on a top surface permitting insertion of a detachable toner cartridge therein;

a locking and releasing mechanism disposed in said main body and locking said detachable toner cartridge in position when said detachable toner cartridge is inserted through said opening on the top surface of said main body, and releasing said detachable toner cartridge out of position from said main body for replacement when a release button positioned on the top surface of said main body is activated; and said detachable toner cartridge comprising a bracket disposed on one side with a locking projection extending from said bracket permitting said locking and releasing mechanism to lock said detachable toner cartridge in position, when said detachable toner cartridge is inserted through said opening on the top surface of said main body.

13. The image forming apparatus of claim 12, further comprised of said detachable toner cartridge comprising a handle formed on a top surface for permitting user to pull said detachable toner cartridge from said main body for replacement, when said release button positioned on the top surface of said main body is activated.

14. The image forming apparatus of claim 13, further comprised of the top surface of said detachable toner cartridge being flush with the top surface of said main body, when said detachable toner cartridge is inserted through said opening on the top surface of said main body, and is locked in position by said locking and releasing mechanism.

15. The image forming apparatus of claim 12, further comprised of said locking and releasing mechanism comprising:

a pivot pin connected to a support frame of said main body;

a locking lever having a hook formed at one end, and pivotable about said pivot pin from a closed position when said detachable toner cartridge is inserted through said opening on the top surface of said main body and said locking projection of said detachable toner cartridge is locked in position by said hook, to an open position when said release button positioned on the top surface of said main body is activated to release said detachable toner cartridge from said main body for replacement; and said release button being operatively connected to another end of said locking lever, and rotating said locking lever about said pivot pin from said closed position to said open position to release said detachable toner cartridge from said main body for replacement upon activation.

16. The image forming apparatus of claim 15, further comprised of said detachable toner cartridge further comprising insertion guides disposed on respective sides to guide the insertion of said detachable toner cartridge into corresponding grooves of a support frame of said main body, when said detachable toner cartridge is inserted through said opening on the top surface of said main body.

17. The image forming apparatus of claim 16, further comprised of the top surface of said detachable toner cartridge being flush with the top surface of said main body, when said detachable toner cartridge is inserted through said opening on the top surface of said main body, and is locked in position by said locking and releasing mechanism.

18. The image forming apparatus of claim 12, further comprised of said locking and releasing mechanism comprising:

a pivot pin connected to a support frame of said main body;

a locking lever having a hook formed at one end, and pivotable about said pivot pin; and said release button operatively connected to another end of said locking lever, enabling said locking lever, upon activation, to rotate about said pivot pin from a closed position to an open position to release said detachable toner cartridge from said main body for replacement.

19. The image forming apparatus of claim 12, further comprised of said detachable toner cartridge further comprising a support body with a compression spring disposed at a bottom to ensure that said detachable toner cartridge is position after insertion through said opening on the top surface of said main body.

20. The image forming apparatus of claim 18, further comprised of a top surface of said detachable toner cartridge being flush with the top surface of said main body, when said detachable toner cartridge is inserted through said opening on the top surface of said main body, and is locked in position by said locking and releasing mechanism.

* * * * *